US006332538B1

(12) United States Patent
Pritchard

(10) Patent No.: US 6,332,538 B1
(45) Date of Patent: Dec. 25, 2001

(54) CONTAINER

(75) Inventor: Barry Douglas Pritchard, Salisbury (GB)

(73) Assignee: R. Twining & Company Limited, Andover (GB)

( * ) Notice: Subject to any disclaimer, the term of this patent is extended or adjusted under 35 U.S.C. 154(b) by 0 days.

(21) Appl. No.: 09/593,208

(22) Filed: Jun. 14, 2000

(30) Foreign Application Priority Data

Feb. 18, 2000 (GB) ..... 0003704

(51) Int. Cl.[7] ..... B65D 81/02

(52) U.S. Cl. ..... 206/574.3; 206/807; 229/148; 229/186

(58) Field of Search ..... 206/524.3, 807; 229/118, 207, 208, 210, 212, 221, 223, 224, 227, 238, 145, 146, 148, 160.2, 225, 186

(56) References Cited

U.S. PATENT DOCUMENTS

| | | | | |
|---|---|---|---|---|
| 3,263,899 | * | 8/1966 | Collura et al. | 229/145 |
| 3,770,486 | * | 11/1973 | Hopermann | 117/15 |
| 3,853,261 | * | 12/1974 | Moore | 229/208 |
| 3,981,434 | * | 9/1976 | Ramich | 229/210 |
| 4,046,313 | | 9/1977 | Perry . | |
| 4,075,372 | * | 2/1978 | Wilinson | 427/258 |
| 4,102,457 | | 7/1978 | Meyers . | |
| 4,239,115 | * | 12/1980 | Froom | 229/145 |
| 4,271,964 | * | 6/1981 | Train | 229/210 |
| 4,555,027 | | 11/1985 | Froom . | |
| 4,712,689 | | 12/1987 | Froom . | |
| 4,838,432 | * | 6/1989 | DePaul | 229/145 |
| 5,105,950 | * | 4/1992 | Gottfreid et al. | 229/210 |
| 5,154,343 | | 10/1992 | Stone . | |
| 5,161,734 | * | 11/1992 | Ruehi et al. | 229/227 |
| 5,265,799 | * | 11/1993 | Stone | 229/225 |
| 5,673,849 | * | 10/1997 | Stone | 229/227 |
| 5,725,144 | | 3/1998 | Stone et al. . | |
| 5,947,368 | * | 9/1999 | Thresher et al. | 229/208 |

* cited by examiner

*Primary Examiner*—David T. Fidei
*Assistant Examiner*—Shian Luong
(74) *Attorney, Agent, or Firm*—Gipple & Hale; John S. Hale

(57) ABSTRACT

A reclosable container (10) is disclosed comprising a box (12) having an opening and comprising a base panel (20), end panels (22, 24), a back panel (26), a front panel (28) and a lid (14) which is hingedly connected to the box. The lid comprises a top panel (30) and a skirt (16) which incorporates a tamper evident seal, preferably formed as a tear strip (18). When the seal has been broken the lid can pivot between a position in which it closes the box and an open position. The container may be formed from a single sheet and a back folded locking arrangement (60) is incorporated in the container.

15 Claims, 5 Drawing Sheets

CONTAINER

The present invention relates to a container, and more particularly, though not exclusively, to a container for use with loose particulate or bagged particulate materials such as, for example, tea, herb, fruit and other similar beverages. It also relates to a container blank, a method of assembling a container and adhesives for use in the assembly of the container.

It is an aim of the present invention to provide a container, or presentation box, which is tamper evident, and reclosable.

It would also be desirable to provide a container which is easy and cheap to construct and fill on a production line, and which uses as little material as possible.

The container of the present invention has thus been designed with a view to overcoming one or more of the following problems:

1. It should be tamper evident;
2. It should be easy to open and be reclosable;
3. It should be lockable to the extent that the contents are not emptied if the container is, for example, accidentally knocked over;
4. It should provide an aroma barrier;
5. It should provide a moisture barrier;
6. It should be constructed to alleviate, as far as possible, dusting; and
7. It should be strong, thus reducing the need for secondary (e.g. cellophane wrap) and tertiary (e.g. boxing for transit) packaging.

These problems have been addressed in a number of ways:

Thus, the container may be made tamper evident by the provision of a lid which is sealed over the opening of a box, which seal is broken by the end-user. This is preferably achieved using a "tear strip" , most preferably one produced by a process called Concora. It will, however, be appreciated that other methods of producing "lines of weakness" could be used.

Most preferably the lid is designed to pivotally open. In a preferred construction the lid comprises a top panel and a skirt and the tear strip runs around all three sides of the skirt. In this way the lid can be integrally and hingedly connected to the box making it easy to open and re-close the container by pivoting the lid over the box's opening.

The applicant has found that the container can be made lockable using a "click lock" mechanism. The preferred "click lock" mechanism is one known as a Z-lock. Thus, by providing a "back fold" on at least a portion of a rim of at least one of the panels which define the box's opening, preferably on the panel opposite the hinge, the skirt of the lid, when the lid is closed, moves over the "back fold" , which is resiliently biased to exert a locking force against it and a raised surface formed on the inside of the skirt of the lid, thus preventing accidental emptying of the container.

Preferably the container is constructed from a barrier board. Preferred barrier coatings include:

1. High density polyethylene (HDPE) which provides an aroma and moisture barrier;
2. Vinyl polymers which provide an aroma and moisture barrier; and
3. Acrylic polymer varnish which also provides an aroma and moisture barrier.

To overcome the problem of dusting (escape of the fine particulate material from the container) it proved necessary to reduce air change within the container. The applicant determined that air change can be reduced by making the container stronger and by creating better seals. One way of achieving this was by reinforcing the container at its vertices and providing deflectors about the rim of the box's opening. The resulting improvement in strength was also found to reduce or alleviate a need for secondary and tertiary packaging.

The vertices are reinforced by increasing the thickness of the carton about them. In one embodiment this is achieved by gusseting. Preferably, an integral gusset is formed from a substantially L-shaped tab situated between the fold lines of a carton blank which when the blank is folded form the vertice. The L-shaped tab is pleated bringing the respective fold lines forming the vertice together and the pleat is then secured by gluing it to a panel adjacent to the vertice. To simplify the gluing procedure one or more apertures are formed in one of the arms making up the L-shape such that by gluing a single surface it is possible to stick the two arms of the L-shape together and the resulting pleat to the panel adjacent to the vertices the adhesive on one of the arms being able to secure the pleat to the panel by virtue of the fact it can pass through the aperture in the other arm. Another significant feature of the invention is the provision of delaminating areas.

A first delaminating area comprises a "die cut" area formed through a layer of the laminate so that the layer of the laminate within the "cut" may be lifted away. This technique allows a tear strip formed in the lid to be glued at its ends to the box so as to seal the container yet, at the same time, enhance ease of opening, since when the tear strip is pulled back the die cut area will lift away. Preferably, the die cut is shaped to terminate in a point which is directed in the direction in which the tear strip is pulled to open the container.

A second delaminating area allows the lid to be glued to the box near its pivot. When the lid is hingedly opened delamination occurs.

A fuller understanding of the delaminating areas will be gleaned from the specific description.

According to one aspect of the present invention there is provided a reclosable container comprising:

a box having an opening and comprising a base panel, two end panels, a back panel, and a front panel; and a lid comprising a top panel and a skirt incorporating a tamper evident seal;

said lid being hingedly connected to said box such that on breaking the tamper evident seal it can pivot between a first position in which it lies over the opening of the box closing the container and a second position in which it is remote from the opening of the box leaving the container open.

Preferably, the container is formed from a single sheet. This saves on materials and reduces assembly costs.

Preferably the box's opening is substantially the same size as the base of the box and includes dust deflector tabs about the rim.

Preferably the tamper evident seal is in the form of a tear strip.

Preferably the container is lockable, and the provision of one or more tabs "back folded" along all or a portion of an edge of the front panel of the box provides the locking means. The back fold is biased to exert a force against the inner face of the lids skirt which preferably also comprises a stop. The resulting appearance gives rise to it being known as a Z-lock.

Preferably the container is constructed of box or carton board although other materials such as, for example, paper, plastics, metal plastics or other metal coated materials could be used.

More preferably the container is constructed from a barrier board (in this case a coated box board). Most preferably the outer most face is coated with a combination of primer and over lacquers which can be conventionally or ultra violet cured. Preferably the lacquers are polyvinyl polymers and acrylic which provide moisture and aroma resistance.

The use of a barrier coating is particularly important for containers carrying beverages containing citrus oils, since these will attack the adhesives traditionally use d in the manufacture of cartons. T he applicant has found that polyamide based adhesives are less prone to degradation by these oils and these are preferred.

An advantage of an acrylic outer most coating is that it can easily be overprinted.

The use of polyamide adhesives in the constructions of the container, the carton blank and the method of constructing the container are separate and further aspects of the present invention.

According to a further aspect of the present invention there is provided a container blank comprising nine panel forming sections, six panel connectors, a locking tab and two deflector tabs which serve to retain particulate material within the box.

The nine panel forming sections comprise five panels which form a box with an opening and four panels which form a lid with a skirt.

The five panels which form the box with an opening are arranged such that the base forming panel is central and two end panels, a front panel and a back panel extend therefrom in the form of a cross.

Four L-shaped panels, disposed between respectively the front and end panels and the back and end panels strengthen the vertices of the box when erected.

Extending from each end panel is a deflector tab which when the blank is folded, extends inwardly from the rim and serves to retain particulate material within the box when erected.

Extending from an edge of the front panel is a tab which when the blank is folded forms a locking means.

The top panel of the lid extends from the back panel of the box and a fold line therebetween serves to hingedly connect the lid to the box when the blank is folded. Extending from the top panel of the lid are three skirt forming panels. Each of the skirt forming panels are sub-divided into three sections, the true skirt forming portion, a portion which forms a tearaway strip and a portion which is used to seal the lid over the opening of the box with glue after the container has been filled.

Extending from the two end forming panels of the lid are tabs which enable the front panel of the lid to be connected to the end panels to thereby form the lid skirt.

According to yet a further aspect of the present invention there is provided a method of constructing and filling a container according to the invention comprising the steps of:

i) forming a box having an opening and strengthened vertices;

ii) filling the box;

iii) forming a lid; and iv) closing the lid over the box's opening and sealing it in place.

According to yet a further aspect of the present invention there is provided the use of a polyamide adhesive in the manufacture of a container which is filled or to be filled with a citrus oil containing beverage.

A specific embodiment of the present invention will now be described by way of example only with reference to the following figures in which.

Figure 1:
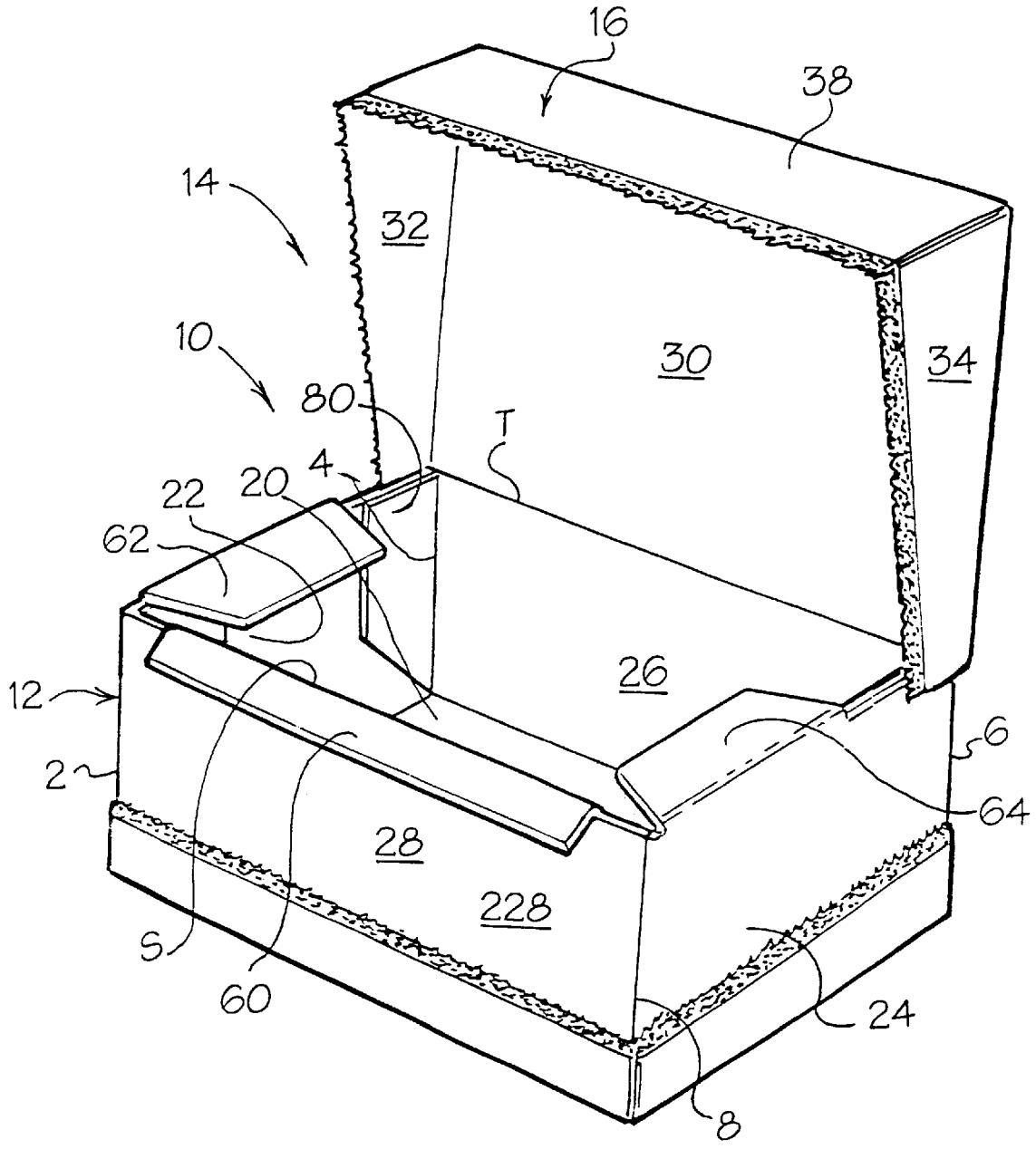
FIG. 1 is a perspective view of an opened container in an "open" configuration.

Referring to FIG. 1 the opened reclosable container 10 of the invention comprises a box 12 having an opening and comprising a base panel 20, two end panels 22, 24, a back panel 26 and a front panel 28, and a lid 14 which is hingedly attached to said box via fold line T. The lid 14 of the opened container comprises a top panel 30 and a skirt 16 comprising end panels 32, 34 and a front panel 38. The skirt 16 of the lid 14 extends over at least a portion of the two end panels 22, 24, and front panel 28 of the box when the "opened" container is closed.

The front panel 28 of the box has a tab 60 which is "back folded" along a line of weakness S towards the outermost face 228 of the front panel 28 of the box 12. This tab, which extends substantially along the whole of fold line S is biased to exert a force against the inner face of the lid's skirt 16 thereby providing a locking means. It also locks against a stop formed by an edge of the glue tabs which are used to form the skirt of the lid.

The end panels 22 and 24 of box 12 are made stronger about the rim of the opening with fold down portions 62 and 64 which also serve as deflectors and help to retain particulate material within the box.

The four vertices 2, 4, 6, 8 of the open box are strengthened with gussets 80. Further details of their construction are given hereinafter.

The increased strength conferred by these gussets 80 makes the container less susceptible to damage during transport alleviating or reducing the requirement for secondary and/or tertiary packaging. It also results in better sealing of the lid 14 once the container has been opened thus resulting in improved user shelf life. It also helps alleviate dusting.

Figure 2:
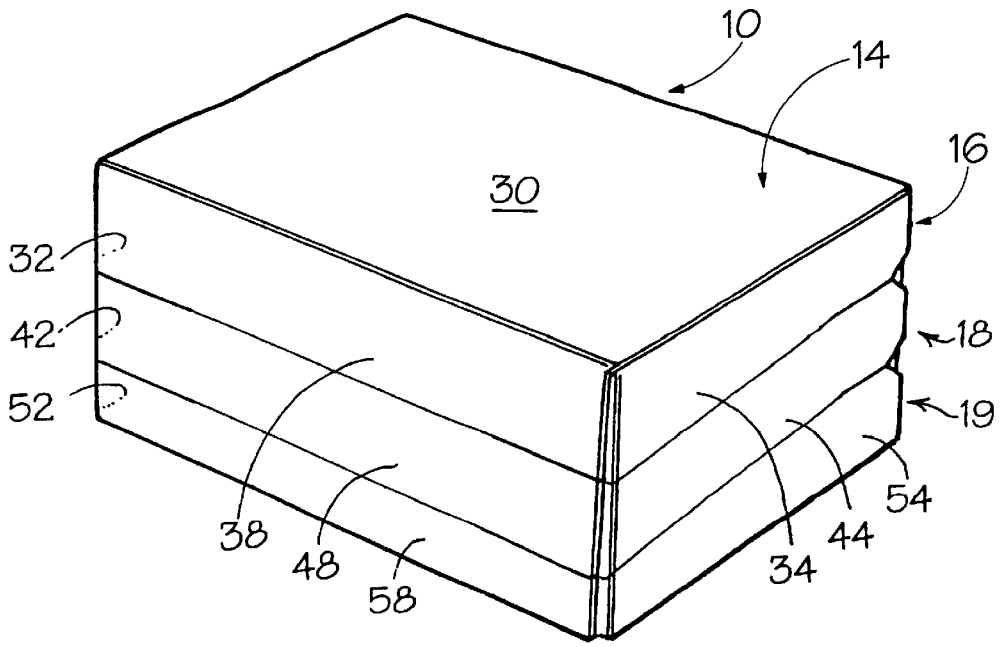
FIG. 2 is a perspective view of an unopened container.

FIG. 2 shows an assembled and filled container 10. The lid 14, at this stage, extends completely over the end panels and front panel of the open box (which are not therefore seen). In addition to a top panel 30 and a skirt 16 comprising two end panels 32 and 34, and a front panel 38, the lid, at this stage, can be considered to additionally comprise a tear away strip 18 comprising sub-panels 42, 44 and 48 and a portion 19 comprising sub-panels 52, 54 and 58 which enable the lid to be sealed and glued over the filled open box.

Figure 3:
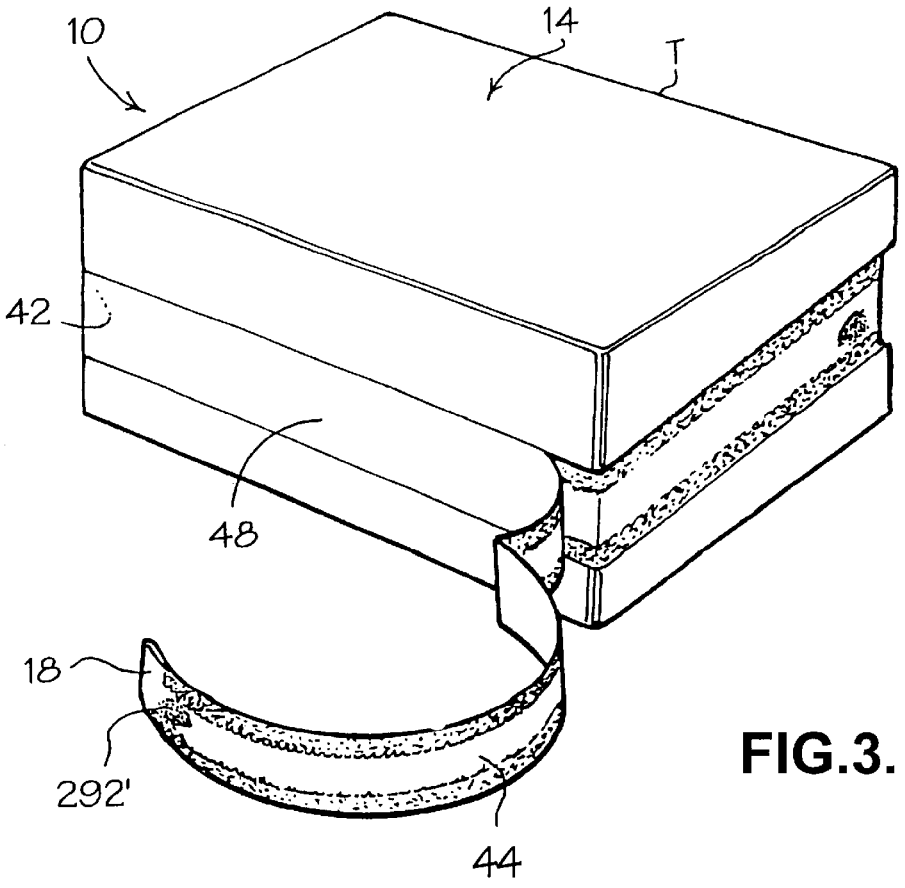
FIG. 3 is a perspective view of a partially opened container.

As shown in FIG. 3, the consumer opens the container 10 by removing the tearaway strip 18. Once the tearaway strip 18, comprising portions 42, 44 and 48, has been removed, the true lid 14 can be pivoted about hinge T between open (see FIG. 1) and closed positions.

Figure 5:
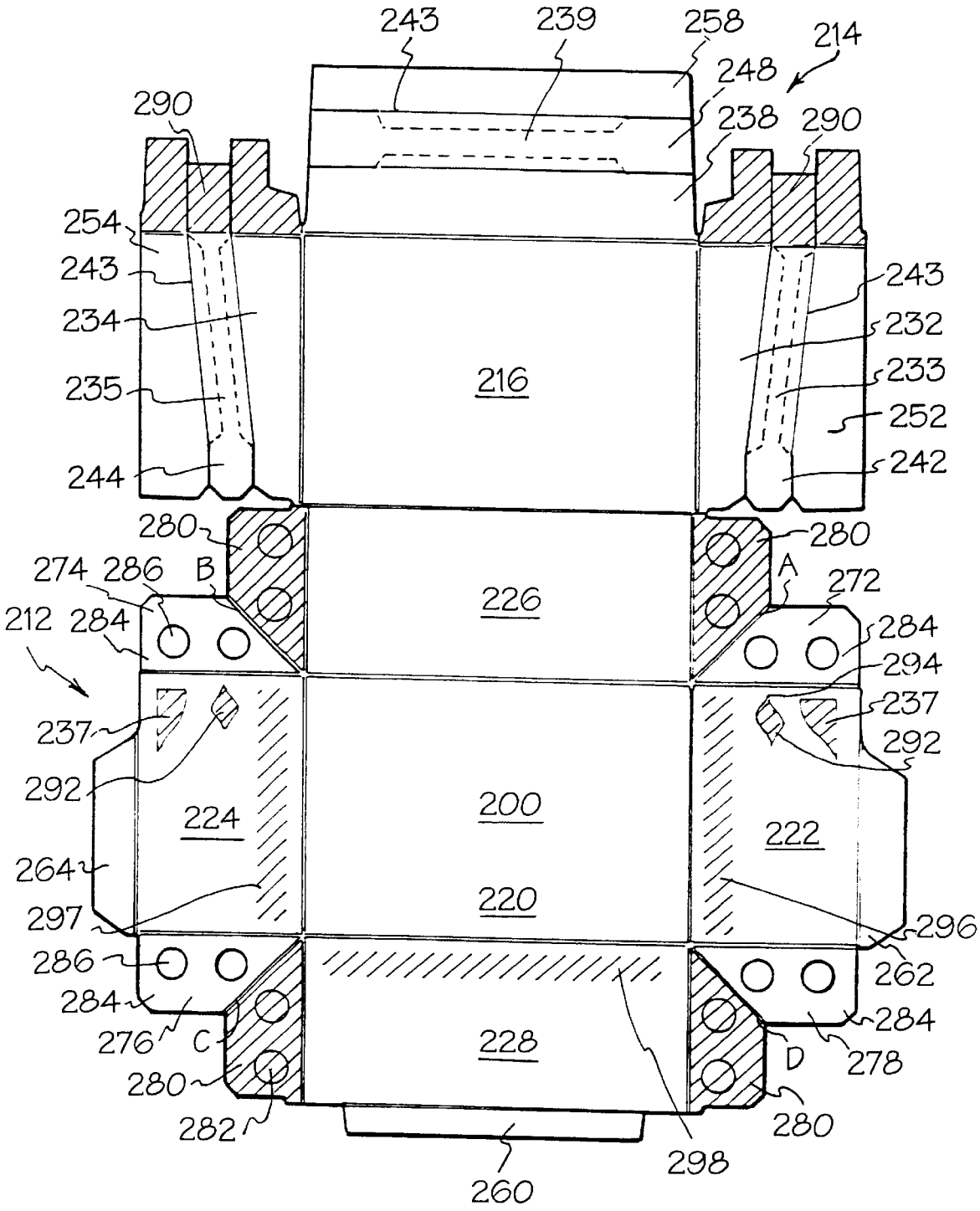
FIG. 5 is a plan view of an outer face of a container blank.
Figure 6:
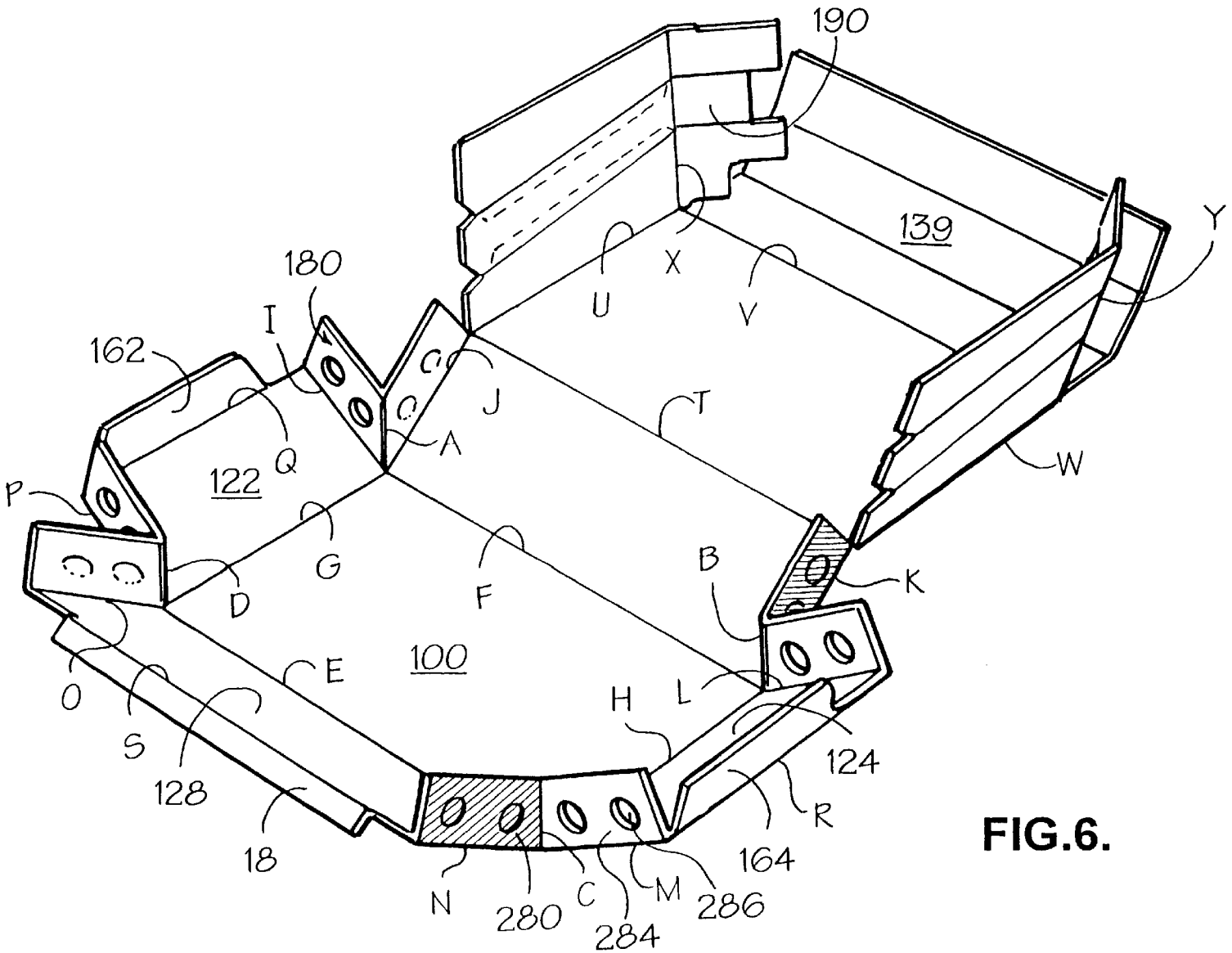
FIG. 6 is a view showing a partially folded container blank.

Many features of the invention can be appreciated more clearly by reference to the container blank (FIGS. 4 and 5) and the way in which the container is assembled (FIG. 6).

Figure 4:
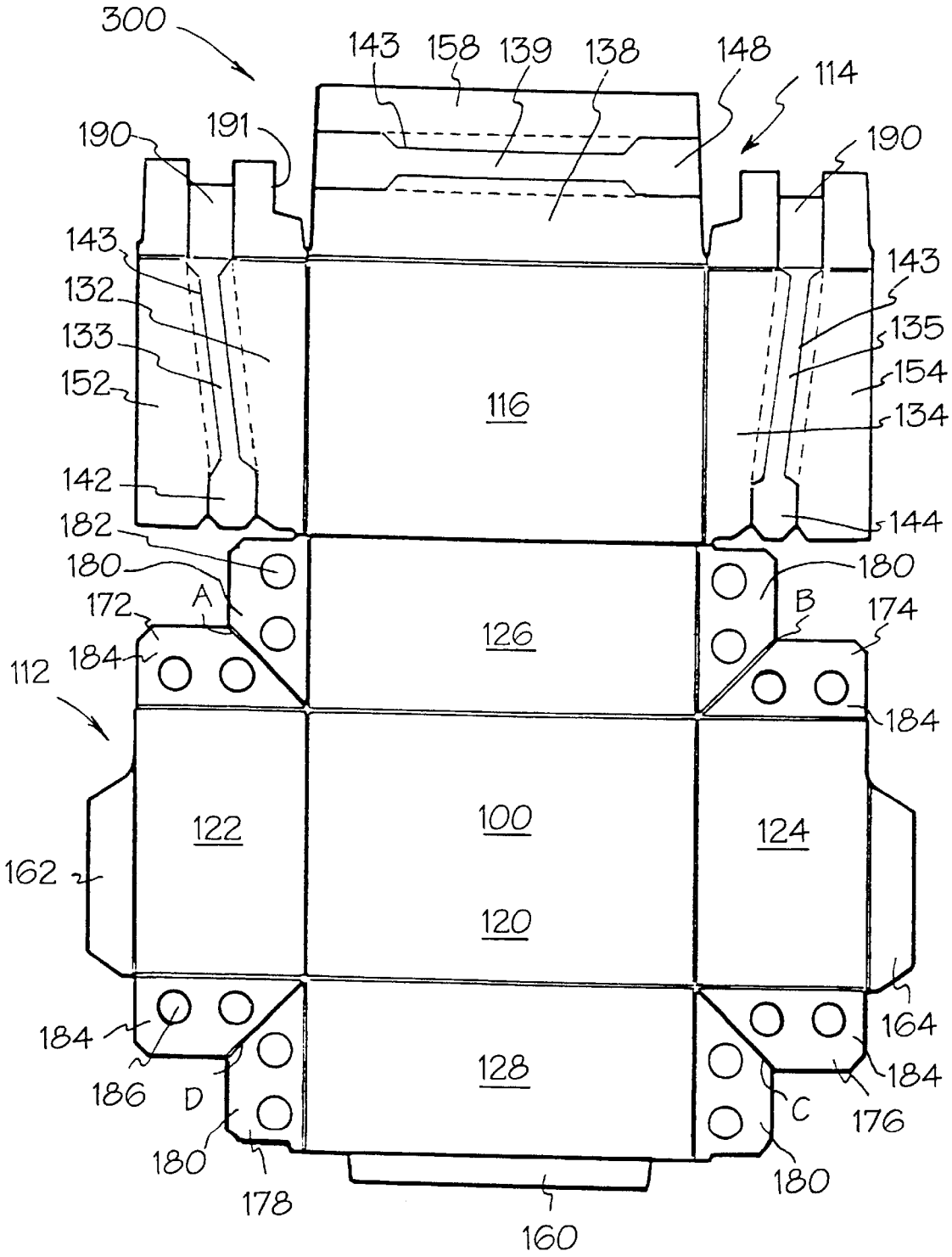
FIG. 4 is a plan view of an inner face of a container blank.

The container blank 300 has an inner face 100 and an outer face 200. Where possible the same numbering is used to refer to like parts. Thus, the number 1 is used to prefix a part to indicate it is the inner face and the number 2 is used to prefix a part to indicate it is the outer face. Referring to FIG. 4 inner face 100 of the container blank comprises a box forming portion 112 comprising a base forming panel 120, two end forming panels 122 and 124, a back forming panel 126 and a front forming panel 128. It additionally comprises a tab 160 which forms the Z-lock, two tabs 162 and 164 which help retain particulate material within the folded box and four gusseting panels 172, 174, 176 and 178 which are substantially L-shaped. It is via these gusseting panels that end panels 122 and 124 are connected to the back panel 126 and front panel 128. Each L-shaped panel comprises a portion 180 with compressed or indented areas 182, and a portion 184 with holes 186 formed therein. Each portion 180 and 184 is separated by a fold line A, B, C or D and when each L-shaped panel 172, 174, 176 and 178 is pleated the compressed areas 182 and holes 186 are aligned (see FIG. 6).

The inner face or the container blank also comprises a lid forming portion 114 comprising a top forming panel 116, end forming panels 133 and 135, a front forming panel 139 and two sets of gluing tabs 190 for connecting end forming panels 133 and 135 to front forming panel 139. These gluing tabs 190 have an edge 191 which assists in the locking of the Z-lock by providing a stop against which tab 160 reacts.

End forming panel 133 comprises three portions, a skirt forming portion 132, a portion 142 which is removed when the box is opened, (i.e. it forms a tear strip) and a portion 152 which enables the lid to be sealed over the filled box.

The portion 142 has lines of weakness 143 marked thereon.

End forming panel 135 similarly comprises three portions, a skirt forming portion 134, a portion 144 which is removed when the box is opened, (i.e. it forms the tear strip) and a portion 154 which enables the lid to be sealed over the filled box.

Portion 144 has lines of weakness 143 marked thereon.

Front panel 139 similarly comprises three portions, a skirt forming portion 138, a portion 148 which is removed when the box is opened (i.e. it forms a tear strip) and a portion 158 which enables the lid to be sealed over the filled box.

The portion 148 has lines of weakness 143 marked thereon.

Referring to FIG. 5 outer face 200 of the container blank comprises a box forming portion 212 comprising a base forming panel 220, two end forming panels 222 and 224, a back forming panel 226 and a front forming panel 228. It additionally comprises a tab 260 which forms the Z-lock, two tabs 262, 264 which provide additional strength to the folded box and function as dust deflectors and four gusseting panels 272, 274, 276 and 278 which are substantially L-shaped. It is via these gusseting panels that end panels 222 and 224 are connected to the back panel 226 and front panel 228. Each L-shaped panel comprises a portion 280 with raised areas 282, and a portion 284 with holes 286 formed therein. Each portion 280 and 284 is separated by a fold line A, B, C or D and when each L-shaped panel 272, 274, 276 and 278 is pleated the raised areas 282 and holes 286 are aligned (see FIG. 6).

The outer face or the container blank also comprises a lid forming portion 214 comprising a top forming panel 216, end forming panels 233 and 235, a front forming panel 239 and two sets of gluing tabs 290 for connecting end panels 233 and 235 to front panel 239. End panel 233 comprises three portions, a skirt forming portion 232, a portion 242 which is removed when the box is opened, (i.e it forms a tear strip) and a portion 252 which enables the lid to be sealed over the filled box.

The portion 242 has lines of weakness 243 marked thereon.

End panel 235 similarly comprises three portions, a skirt forming portion 234, a portion 244 which is removed when the box is opened, (i.e forms the tear strip) and a portion 254 which enables the lid to be sealed over the filled box.

Portion 244 has lines of weakness 243 marked thereon.

Front panel 239 similarly comprises three portions, a skirt forming portion 238, a portion 248 which is removed when the box is opened (i.e. it forms a tear strip) and a portion 258 which enables the lid to be sealed over the filled box.

The portion 248 has lines of weakness 243 marked thereon.

There are, however, a number of differences. Thus areas 282 the reverse of areas 182, are raised areas in contrast to the indented areas 182.

Each panel 222 and 224 is also provided with a gluing area (shown in shading) and a die cut area the function of which is described later, and a delaminating area 292. The delaminating areas 292 are lemon shaped with ends 294 which are directed in the direction of the tear axis of the tear strip. Both areas 237 and 292 along with areas 296, 297 and 298 and the gussets 280 and the tabs 290 are coated with an adhesive (shown in shading).

To construct the container 10 from the blank 300 the blank is folded along the fold lines A to Y as shown in FIG. 6. The inner face 100 is shown upwardly.

A box 12 is formed by pleating L-shaped panels 180 such that they are glued to inner faces 122 and 124 of the end panels 22, 24. The glue, which is preferably a polyamide based glue, is disposed on the outer face portion 280 of the L-shaped panels 272, 274, 276 and 278.

The box 12 is constructed by folding the respective L-shaped panels inwardly about fold lines A, B, C, and D and E, F, G and H to create an open box. The glue on outer face 280 of the L-shaped panels glues the arms 280 and 284 together. The glue passes through holes 286 and the vertices 2,4,6,8, (FIG. 1) are thus strengthened by the gluing of the gussets 272, 278 and 274 and 276 to panels 222 and 224 respectively. Tabs 62 and 64 are then folded over through 90° so that inner face 162 is folded towards inner face 122 and inner face 164 is folded towards inner face 124. Tab 18 is reverse folded towards the outer face 228 to form a Z-lock.

The pleating of the L-shaped portion 180 and their fixation to the sides 22 and 24 strengthens each vertices IJ, MN and OP and additional strength is provided by the folding of tabs 62 and 64 over sides 22 and 24 towards inner face 122 and 124 respectively.

The lid portion 14 is created by folding the respective panels inwardly about fold lines U, V and W and gluing the outer face of the tabs 290 to the inner face 139 of the front panel 39. The lid is then pivoted closed about fold line T and secured over the open box by gluing at glue areas 296, 297, 298, 237 and 292.

To open the container as illustrated in FIG. 3, tear strip 18 is removed. Strip 42 which is glued to the box at delaminating areas 292, is peeled back causing delamination at areas 292, thus avoiding unsightly tearing. The lid can then be pivotally opened causing delamination at the delaminating area 237. On pivoting the lid back to close the box reverse folding tab 60 functions as a Z-lock closure exerting pressure against inner face 138 of the lid and the edge 191 of gluing tabs 190 which act as stops.

What is claimed is:

1. A reclosable container comprising:

a box having an opening and comprising a base panel, end panels, a back panel, a front panel and gusseting panels connecting the end panels to respective front and back panels; and a lid comprising a top panel and a skirt incorporating a tamper evident seal;

said lid being hingedly connected to said box such that after breaking of the tamper evident seal said lid can pivot between a first position lying over the opening of the box closing the container and a second position leaving the container open;

said gusseting panels defining holes for receiving glue.

2. A reclosable container as claimed in claim 1 wherein the container is formed from a single sheet.

3. A reclosable container as claimed in claim 1 wherein the opening is substantially the same size as the base panel.

4. A reclosable container as claimed in claim 1 wherein the opening has a rim about which are provided dust tabs.

5. A reclosable container as claimed in claim 1 wherein the tamper evident seal is in the form of a tear strip.

6. A reclosable container as claimed in claim 1 comprising at least one back folded tab positioned along at least a portion of an edge of the front panel of the box by means of which the container is lockable.

7. A reclosable container as claimed in claim 6 wherein each back folded tab is biased to exert a force on the skirt when the lid is in a first position, the skirt providing a stop for the lid.

8. A reclosable container as claimed in claim 7 wherein the back folded tab forms a locking mechanism.

9. A reclosable container as claimed in claim 1 constructed from barrier board.

10. A reclosable container as claimed in claim 9 wherein the board's outermost face is coated with a combination of primer and cured over lacquers which are ultra violet cured.

11. A reclosable container as claimed in claim 10 wherein the lacquers are selected from a group consisting of polyvinyl polymers and acrylic.

12. A reclosable container as claimed in claim 1 wherein said panels are secured together with polyamide adhesive.

13. A reclosable container as claimed in claim 1 wherein said container comprises a coated barrier board which provides an aroma and moisture barrier suitable to hold a citrus oil beverage.

14. A reclosable container as claimed in claim 1 wherein said gusseting panels comprise one section provided with raised areas aligned with holes defined by another section when the container is assembled.

15. A reclosable container as claimed in claim 1 wherein said gusseting panels are L-shaped.

* * * * *